United States Patent [19]

Bouldin

[11] Patent Number: 4,712,919

[45] Date of Patent: Dec. 15, 1987

[54] CONTINUOUS SOIL MIXING APPARATUS

[75] Inventor: Floyd E. Bouldin, McMinnville, Tenn.

[73] Assignee: Bouldin & Lawson, Inc., McMinnville, Tenn.

[21] Appl. No.: 670

[22] Filed: Jan. 6, 1987

[51] Int. Cl.[4] ..... B01F 15/00

[52] U.S. Cl. ..... 366/133; 366/16; 366/155; 366/177; 366/182; 366/325

[58] Field of Search ..... 366/16, 18–21, 366/27, 28, 49, 33, 76, 150, 10, 154, 155, 177, 133, 182, 186, 194, 261, 271, 279, 325, 328, 329; 241/101 B; 198/688.1, 698, 498

[56] References Cited

U.S. PATENT DOCUMENTS

| | | | |
|---|---|---|---|
| 2,721,359 | 10/1955 | Morgan | 366/186 X |
| 3,172,177 | 3/1965 | Brauchla | 366/13 |
| 4,022,439 | 5/1977 | Groth | 366/16 |
| 4,136,964 | 1/1979 | Swisher, Jr. | 198/688 X |
| 4,324,495 | 4/1982 | Martinez | 198/498 X |
| 4,360,044 | 11/1982 | Wisneski | 366/49 X |

FOREIGN PATENT DOCUMENTS

| | | | |
|---|---|---|---|
| 112757 | 8/1899 | Fed. Rep. of Germany | 366/177 |
| 518904 | 6/1929 | Fed. Rep. of Germany | 366/16 |

*Primary Examiner*—Timothy F. Simone
*Attorney, Agent, or Firm*—Harrington A. Lackey

[57] ABSTRACT

A continuous soil mixing apparatus including a series of soil feed hoppers and a mixing chamber, all supported over an elongated, endless, single conveyor belt to carry layers of soil of different compositions from the different feed hoppers to the mixing chamber. The first soil hopper remote from the mixing chamber incorporates a soil agitator and deposits its soil directly upon the conveyor belt, while the remaining hoppers incorporate independent feed belts above the conveyor belt.

14 Claims, 11 Drawing Figures

CONTINUOUS SOIL MIXING APPARATUS

BACKGROUND OF THE INVENTION

This invention relates to a soil mixing apparatus, and more particularly to an apparatus for continuously mixing different soils primarily for nursery stock.

Soil mixing devices for nursery stock are known in the art. One conventional soil mixing apparatus incorporates a plurality of feed hoppers, each feed hopper adapted to receive a soil of different composition from the other feed hoppers. Each hopper includes an elongated feed belt in its bottom portion to discharge the soil from that particular hopper. The hoppers and their feed belts are independently mounted above an elongated conveyor belt for carrying the layers of soil from the feed hoppers to a mixing chamber. Only a single agitator is included in the first or leading feed hopper for agitating the denser soil. Thus, if the conventional apparatus utilized three feed hoppers for three different soils, four conveyor belts were required, one feed belt for each hopper and the elongated underlying conveyor belt. Not only are feed belts expensive, but each feed belt occupies the bottom portion of the hopper, which might otherwise be utilized for containing additional soil.

A popular prior art method of mixing soils for plant stock is "batch mixing", which involves depositing all the soils within a single large hopper and agitating and mixing the soils within the hopper. In batch mixing, more labor is required in order to both measure and introduce the different soils into the single hopper. Furthermore, in batch mixing, there is a tendency for the soil particles to break down and loose their integrity, thereby reducing the porosity and moisture-holding capacity of the soils. The mixer blades in batch mixing tend to break down the long fibers of peat moss, which assist in holding the soil materials and moisture around the plant. Moreover, batch mixing tends to rupture and remove the coating from the time-release fertilizer pellets included in the soil mixture.

Furthermore, in batch mixing, the operation is not continuous because the mixed soil cannot be conveyed to its next destination while the soil is being introduced into the hopper, agitated, and mixed. Thus, the feeding of the soil in the batch mixing process is intermittent.

SUMMARY OF THE INVENTION

It is therefore an object of this invention to provide a continuous soil mixing apparatus in which the feeding of the various soils is carefully and automatically controlled while the soils are being continuously fed, conveyed and mixed.

In the apparatus made in accordance with this invention, the feed hoppers for each soil are mounted in series above an elongated continuously moving conveyor belt for feeding the separate soils fed from the hoppers in layers toward the mixing chamber.

In the initial hopper, the one most remote from the mixing chamber, the feed belt is eliminated, and the underlying conveyor belt is utilized to carry the soil from the open bottom of the initial hopper toward the mixing chamber. Because of the elimination of the feed belt from the first hopper, more soil may be contained within a feed hopper of the same size as a feed hopper including a feed belt. Morever, a pair of vertically spaced agitator shafts may be incorporated within the lower portion of the initial feed hopper for agitating the soil and eliminating bridging of the soil within the bottom of the hopper. In the subsequent downstream hoppers, feed belts are utilized to carefully control the deposit of the respective soils in layers upon the bottom layer of soil from the initial hopper.

Chemical hoppers may also be located above the conveyor belt between the feed hoppers and the mixing chamber for introducing soil chemicals, such as limes, fertilizers, herbicides, fungicides, and wetting agents.

Adjustable gates are provided in the downstream walls of the respective hoppers for regulating the height of the discharge openings and therefore the level of the respective soil layers deposited upon the conveyor belt and upon each other. Once the speed of the respective belts and the height of the gates are established, the apparatus may be continuously operated to provide a controlled blend of the soils without any further intervention by the operator except to introduce soils to the respective hoppers. The variations in the relative proportions of the soils in the blended mixture may be made by varying the height of the corresponding gates, and in some instances by varying the speed of the feed belts relative to the underlying conveyor belts.

DESCRIPTION OF THE PREFERRED EMBODIMENT

Figure 1:
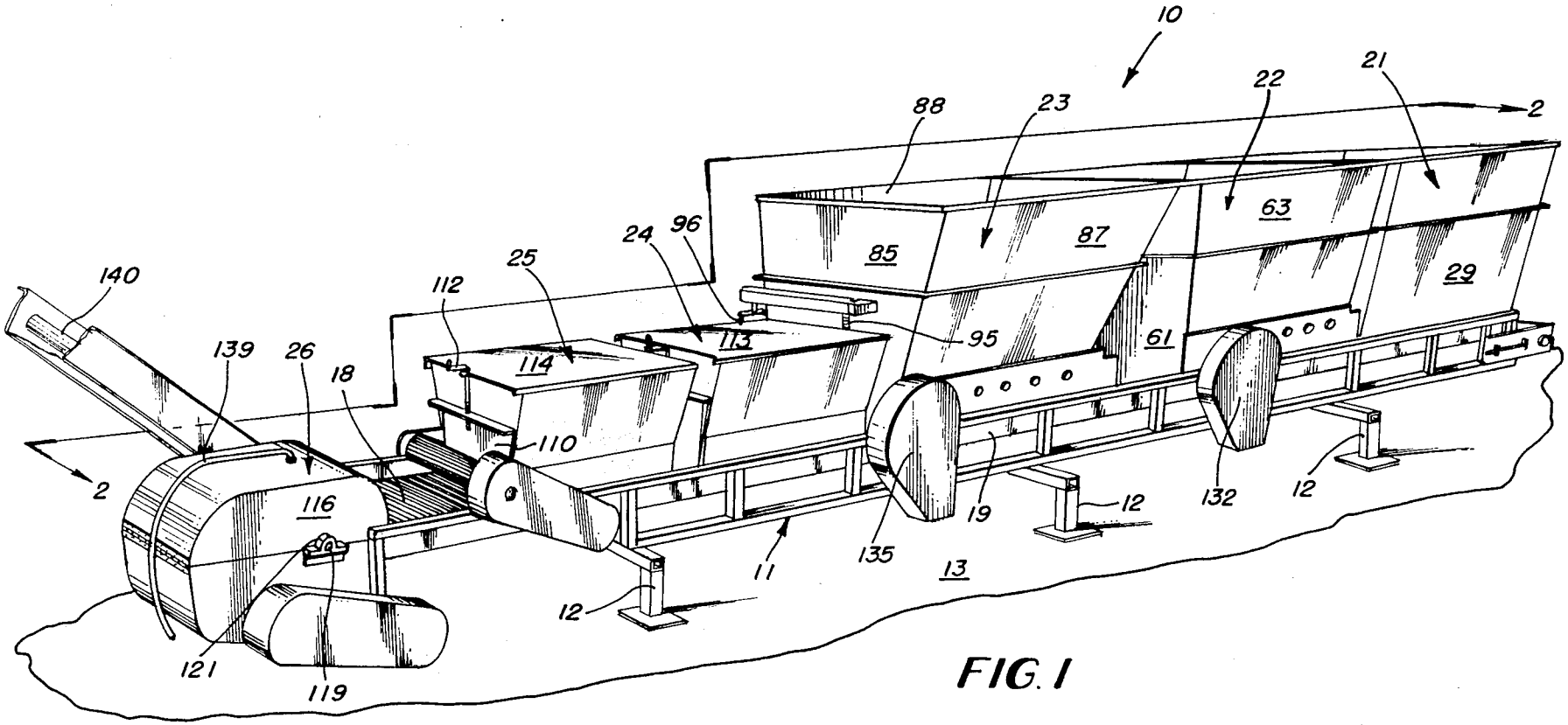
FIG. 1 is a right side perspective view, looking upstream, of the continuous soil mixing apparatus made in accordance with this invention.
Figure 2:
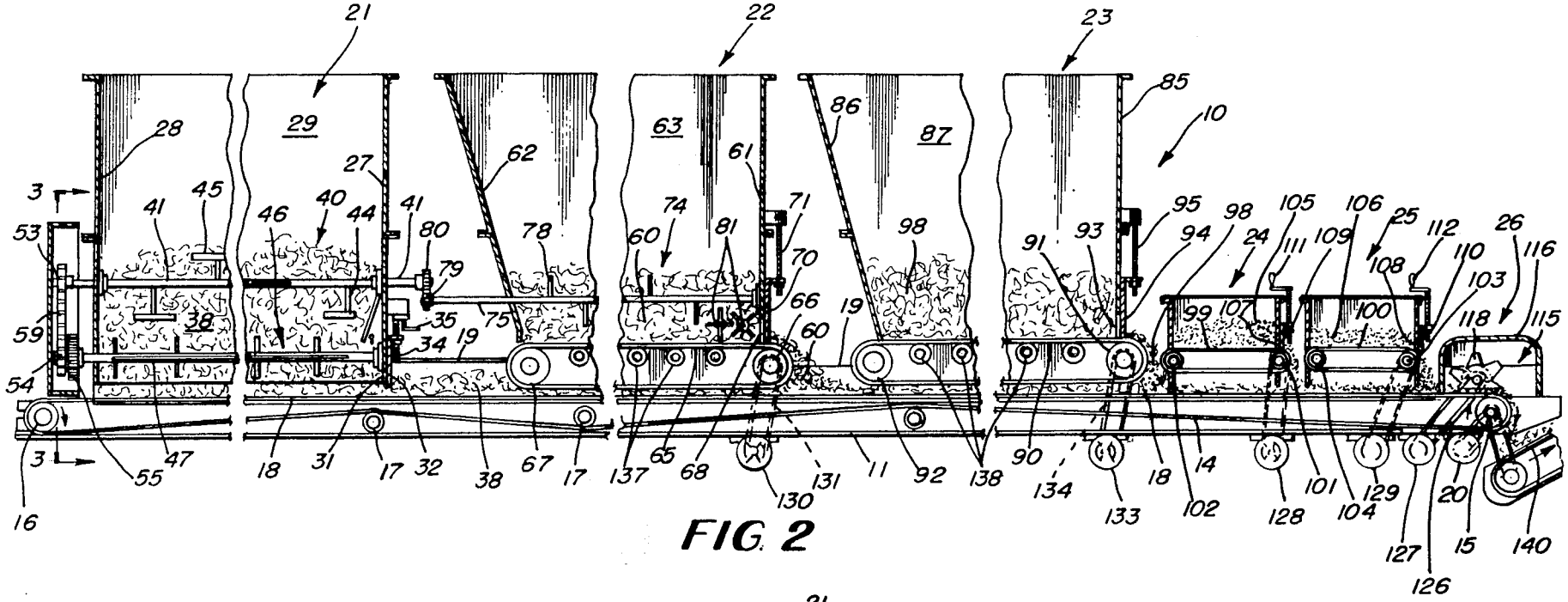
FIG. 2 is a fragmentary, longitudinal section taken along the line 2—2 of FIG. 1, with parts broken away, to show the continuous operation of feeding the layers of soil to the mixer.

Referring now to the drawings in more detail, FIGS. 1 and 2 disclose the preferred embodiment of the apparatus 10 made in accordance with this invention.

As disclosed in the drawings, the apparatus 10 includes an elongated frame 11, supported upon legs 12, upon a floor or other ground engaging surface 13.

Mounted longitudinally upon the base frame 11 is an elongated conveyor belt 14 trained about the head roller 15 at the front of the apparatus 10 and by the tail roller 16 at the rear end of the frame 11. Because of the length of the endless belt 14, a plurality of idler rollers 17, as best disclosed in FIG. 2, may be employed to maintain tension and reduce sagging in the belt. The upper or top run 18 of the belt 14 is maintained generally horizontal during its forward movement by means such as a rigid trough 19 fixed to the frame 11 over which the top run 18 of the belt conveyor travels, or it may be supported by a plurality of idler rollers, not shown. The head roller 15 is driven by a conveyor drive motor 20 through any appropriate transmission disclosed in FIG. 2.

Mounted upon the frame 11 above the endless belt 14 and longitudinally spaced the length of the frame 11, are a first feed hopper 21, a second feed hopper 22, a third feed hopper 23, a first chemical hopper 24, a second chemical hopper 25, and a mixer device 26.

As best disclosed in FIGS. 1–5, the first feed hopper 21 has front and rear end walls 27 and 28, a pair of down ward converging side walls 29 and 30, an open top and an open bottom.

Formed in the front wall 27 of the first hopper 21 is a discharge opening 31 covered by a vertically adjustable gate 32. The gate 32 has a flange 33 with an internally threaded opening for receiving the vertical screw or worm 34 adapted to be rotated by the handle 35 through a transmission 36.

The side walls 29 and 30 of the first hopper 21 termiate at their bottom edges within the trough 19 and very close to the level of the upper belt run 18 of the conveyor belt 14.

The first hopper 21 is adapted to receive a first soil 38, such as peat moss. The soil 38 is introduced by any convenient means, not shown, either by hand or other conveyor through the open top of the first hopper 21. The soil 38 gravitates downwardly through the open bottom of the first hopper 21 and directly upon the top run 18 of the conveyor belt 14, as clearly illustrated in FIG. 2.

Because of the density and of the self-adherence of the first soil 38, such as peat moss, an upper agitator 40 in the form of an elongated rotary agitator shaft 41 extends the entire length of the first hopper 21 and is journaled for rotary movement in the respective end bearings 42 and 43. The rotary shaft 41 is provided with longitudinally spaced, radially extending agitator rods 44 terminating in beaters or paddles 45 which are perpendicular to the rods 44 and parallel to the rotary shaft 41.

Spaced below the upper agitator 40 is a lower agitator 46 including an elongated rotary shaft 47 extending the length of the hopper 21 and journaled in the respective bearings 48 and 49 in the front and rear walls 27 and 28 of the first hopper 21. The lower agitator shaft 47 is provided with a pair of elongated diametrically opposite vanes 50 and pairs of longitudinally or axially spaced agitator rods 51. The agitator rods 51 oppose each other and extend in opposite radial directions from the lower agitator shaft 48, as best disclosed in FIGS. 4 and 5.

Figure 3:
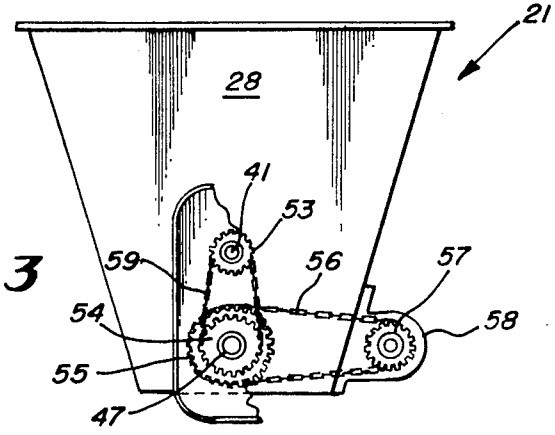
FIG. 3 is an enlarged, fragmentary section taken along the line 3—3 of FIG. 2, of the rear of the first feed hopper, with portions of the agitator drive housing broken away.
Figure 4:
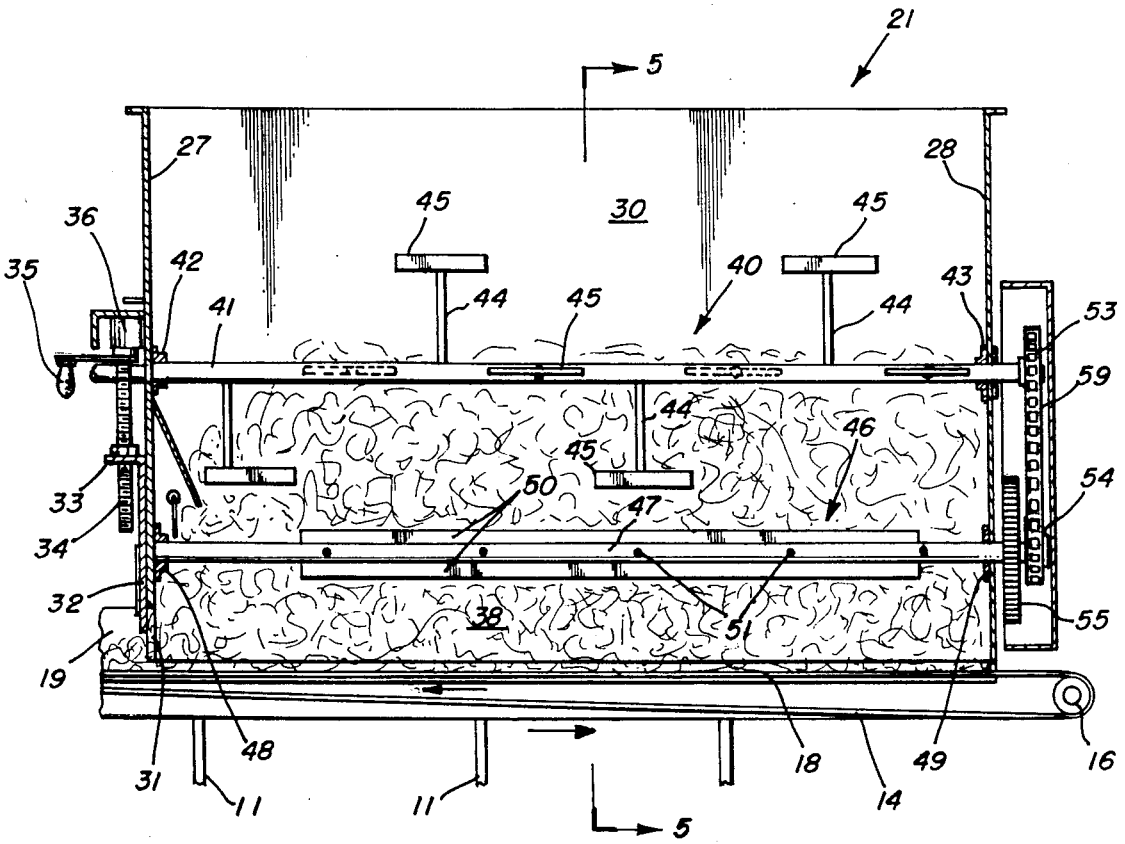
FIG. 4 is an enlarged, fragmentary section taken along the line 4—4 of FIG. 5, of the first feed hopper.
Figure 5:
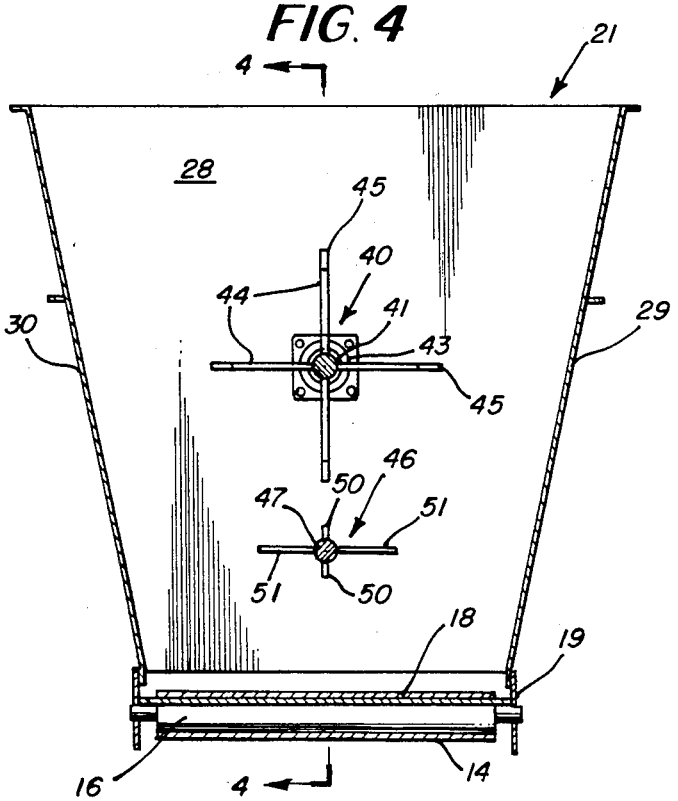
FIG. 5 is a section taken along the line 5—5 of FIG. 4, of the first feed hopper, with the soil removed.
Figure 6:
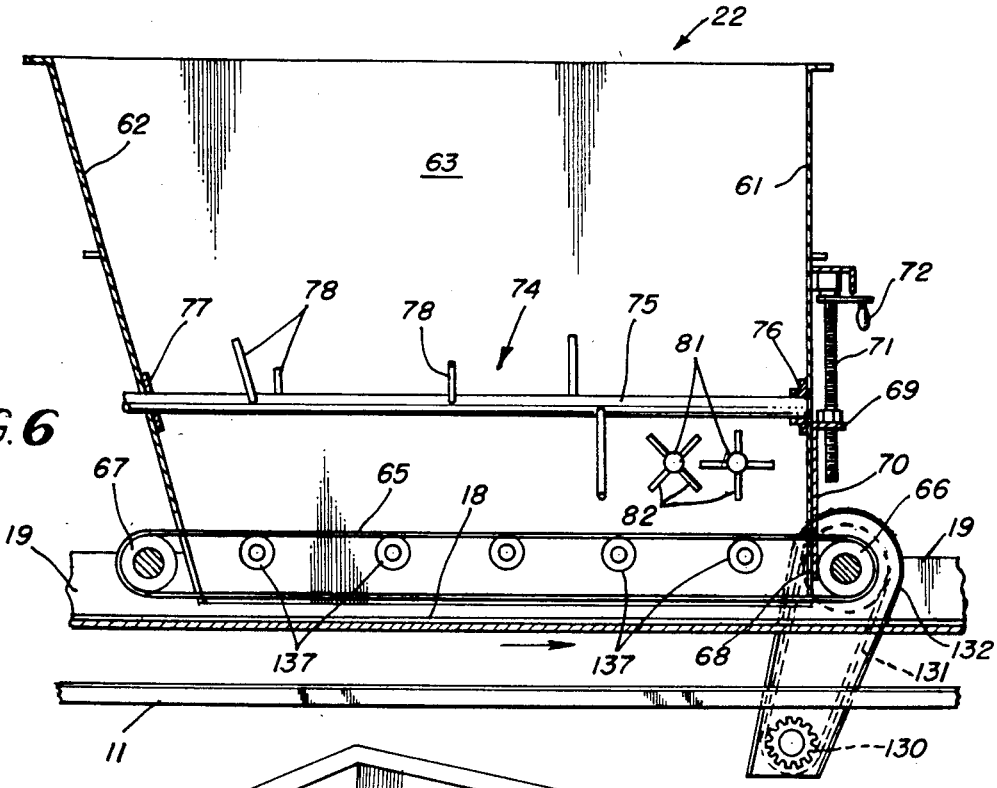
FIG. 6 is an enlarged, fragmentary, longitudinal section of the second feed hopper.

The rear end portion of the upper rotary shaft 41 projects through the rear wall 28 and terminates in an upper sprocket 53 (FIGS. 3 and 4). The rear end of the lower agitator shaft 47 projects through the rear wall 28 and terminates in a lower sprocket 54. Mounted co-axially upon the shaft extension 47 adjacent the sprocket 54 is a driven sprocket 55 connected by chain 56 to drive sprocket 57 driven by agitator motor 58. The upper and lower sprockets 53 and 54 are linked by the chain 59.

The top agitator 40 is designed to agitate the soil 38, such as peat moss, to prevent it from sticking, becoming packed, and bridging, while the lower agitator 46 agitates the soil 38 primarily to prevent bridging of the dense soil 38 in the lower, narrower portion of the first hopper 21, to facilitate feeding of the soil 38 upon and with the conveyor belt 14.

While the lower agitator shaft 47 terminates at its front end in the front bearing 48, the upper or top shaft 41 projects through its bearing 42 and the front wall 27, as disclosed in FIGS. 2 and 4.

The second feed hopper 22 is designed to handle and feed a soil 60 which is of different composition from the soil 38. The soil 60 may consist of bark, sand, or topsoils. The second hopper 22 includes a front end wall 61, disposed substantially vertically, as disclosed in FIG. 2, and a rear and wall 62, which slopes forward and downward as best disclosed in FIG. 2. The second hopper 22 also includes opposite side walls 63 and 64. The top of the second hopper 22 is open and the bottom of the second hopper 22 is also open, but elevated so that the bottom of the hopper 22 is closed by an endless feed belt 65. The feed belt 65 is trained about head roller 66 and tail roller 67 rotatably supported in the frame 11. The lower portion of the front wall 61 is provided with a discharge opening 68, covered by gate 70 having a flange 69 with an internally threaded hole for receiving the vertical rotary screw or worm 71 adapted to be rotatably controlled by crank 72.

The second feed hopper 22 is also provided with an agitator 74 including an elongated rotary shaft 75 journaled in the bearings 76 and 77 respectively in the front and rear walls 61 and 62. Longitudinally spaced and projecting radially from the rotary shaft 75 are a plurality of agitator rods or tines 78.

While the front end portion of the rotary shaft 75 terminates in the front bearing 76, the rear end portion of the same rotary shaft 75 projects through the rear bearing 77 and terminates in a spur gear 79, which meshes with another spur gear 80 fixed upon the front end of the extended portion of the upper agitator shaft 41, as best disclosed in FIG. 2. The spur gears 79 and 80 are preferably of equal size and have an equal number of teeth.

Thus, the speed of the agitator shaft 71 in the second hopper 22 is the same as the speed of the upper agitator shaft 41 in the first hopper 21. The function of the agitator 74 is to agitate or stir up the lighter density soil 60 before it is fed by the feed belt 61 through the discharge opening 68 to drop upon the horizontal conveyor belt 14.

Figure 7:
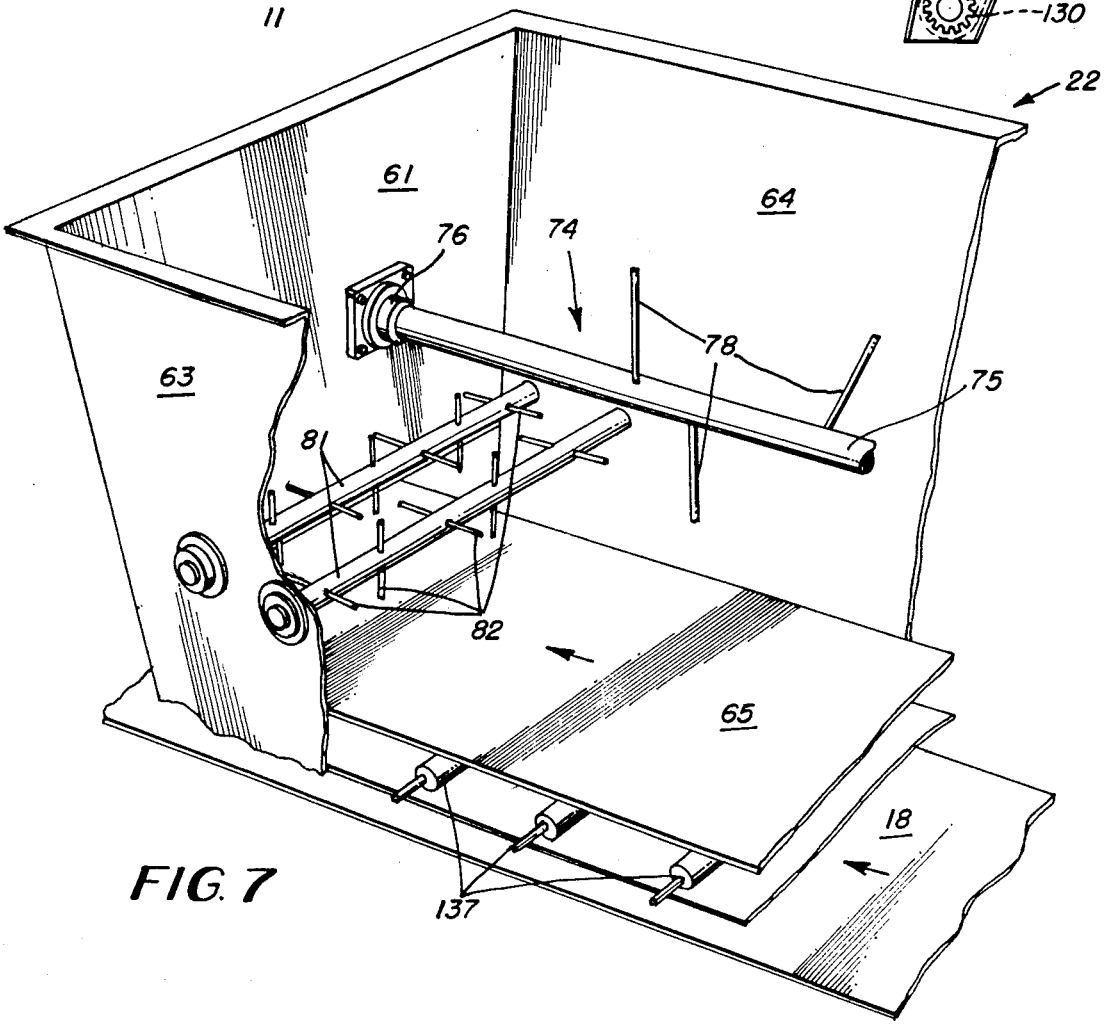
FIG. 7 is an enlarged, fragmentary perspective view of the downstream end portion of the second feed hopper, with portions broken away.
Figure 8:
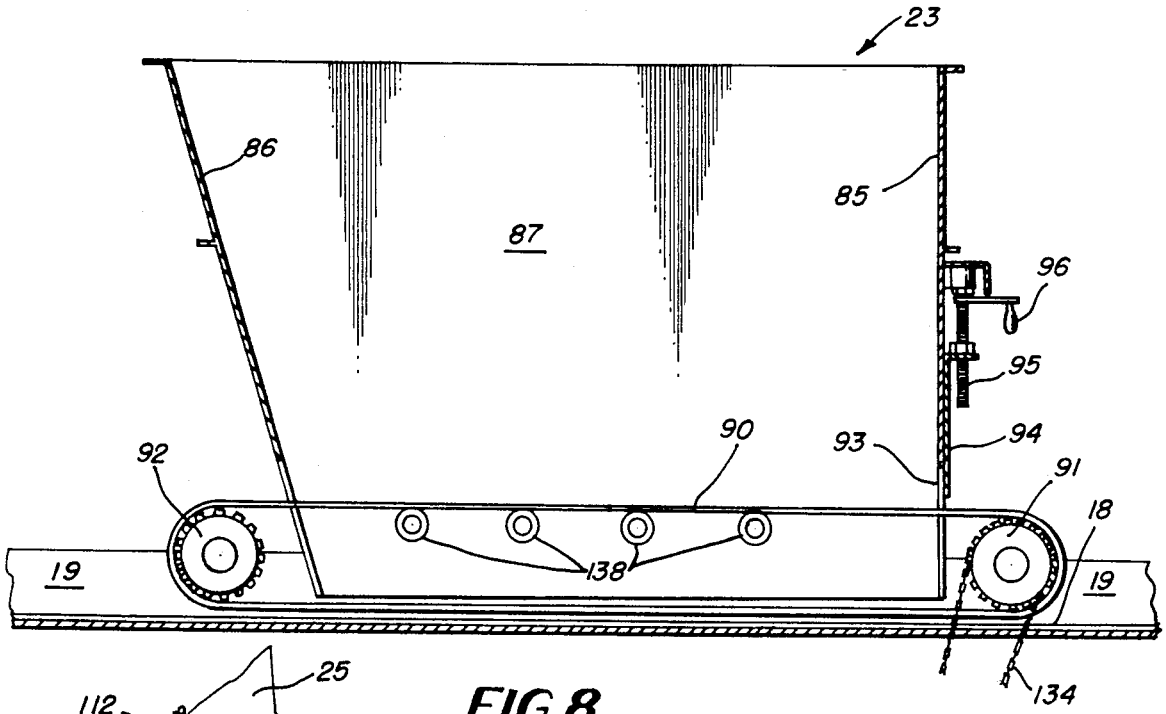
FIG. 8 is an enlarged, longitudinal, fragmentary sectional elevational view of the third feed hopper.

If desired, transverse agitator shafts 81 having radial tines 82 may be journaled in the lower front portion of the hopper 22, as disclosed in FIG. 7, in order to further agitate the soil 60, and particularly to prevent bridging of the soil within the bottom portion of the hopper 22.

If desired, a third hopper 23 may be employed downstream of the second hopper 22. The third hopper 23 is of substantially the same construction and shape as the second hopper 22, except that hopper 23 does not include any agitator device. The third hopper 23 includes a front wall 85, a rear wall 86 and side walls 87 and 88 of the same size and shape of the corresponding walls 61–64 of the second hopper 22.

The third hopper 23 is provided with a lower feed belt 90 substantially the same as the feed belt 65 in the bottom of the second hopper 22, and is trained about its corresponding head roller 91 and its tail roller 22.

In the lower edge portion of the front end wall 85 is a discharge opening 93 covered by the gate 94 which is controlled by the vertical threaded worm 95 and the crank handle 96, which structure is identical to the corresponding gate 70, worm 71, and crank handle 72 mounted on the second hopper 22.

The third hopper 23 is designed to receive and discharge a soil 98 which is of a different composition from either the soil 38 or the soil 60 handled by the respective first hopper 21 and the second hopper 22. The soil 98 is of a composition and density which is generally fluent, non-binding and relatively dry, which requires no agitation. Accordingly, no agitator is incorporated in the third hopper 23. Examples of soil 98 would be sand, perlite, vermiculite, Styrofoam, brick chips, or sawdust.

As illustrated in FIGS. 1 and 2, the chemical hoppers 24 and 25 are likewise provided with endless feed belts 99 and 100 trained about their respective head and tail rollers 101, 102, 103, and 104 for feeding chemical additives 105 and 106 through discharge openings 107 and 108 controlled by gates 109 and 110 operated by crank handles 111 and 112 in the same manner as the gates 94 and 70. The chemical additives may be any type of fertilizers, herbicides, fungicides or wetting agents. Each of the chemical hoppers 24 and 25 has an open top and is provided with front, rear, and side walls for containing the chemical additives 105 and 106 upon the respective feed belts 99 and 100. Each of the chemical hoppers 24 and 25 may be provided with a lid or cover 113 and 114, respectively.

Figure 9:
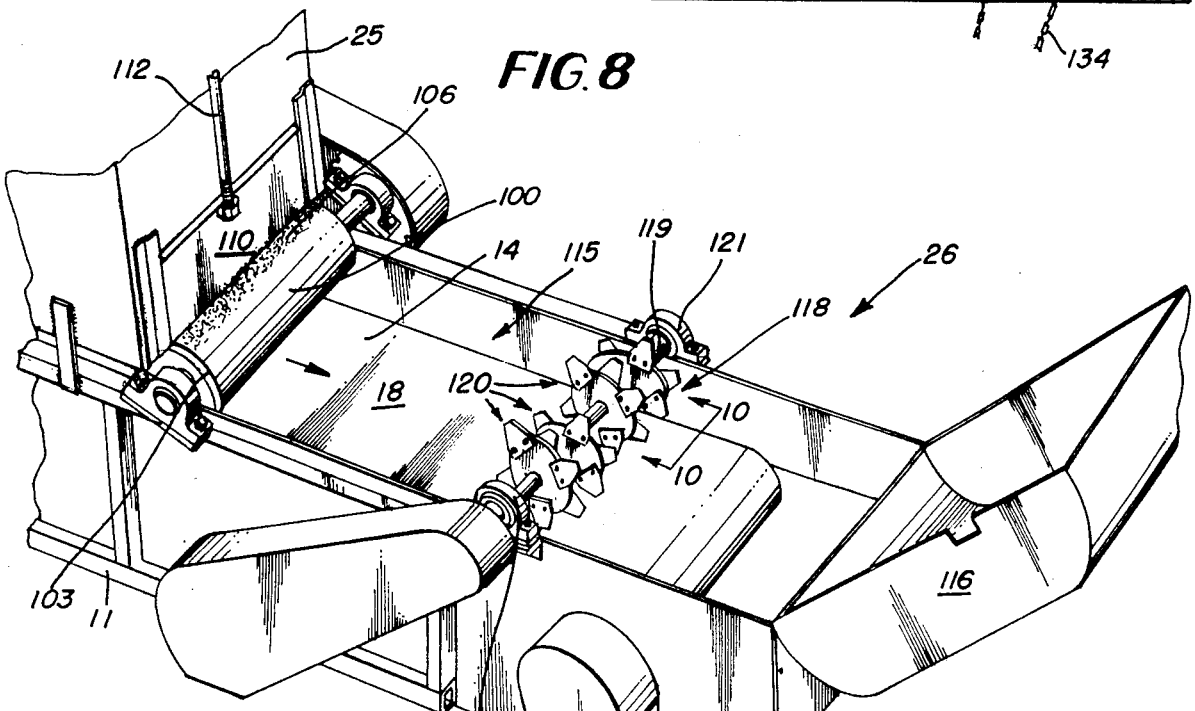
FIG. 9 is a top, front, fragmentary perspective view of the apparatus including the mixing chamber with the cover open, and a portion of the second chemical hopper.

As best disclosed in FIGS. 2 and 9, the mixer device 26 includes an open-bottom mixing chamber 115 in which the floor or bottom of the mixing chamber 115 is defined by the front end portion of the upper run 18 of the endless conveyor belt 14. The chamber 115 is adapted to be closed by a cover or lid 116.

Mounted transversely within the mixing chamber 115 is a mixer head 118 including an elongated shaft 119 supporting a plurality of axially spaced knife members 120. The opposite ends of the mixing shaft 119 are journaled for rotary movement in opposed bearings 121 and 122.

Each of the knife members 120 includes a circular disk or hub 123 to the periphery of which are fixed a plurality of circumferentially spaced triangular knife blades 124. As best disclosed in FIGS. 10 and 11, each hub 123 supports three knife blades 124 on one surface of the hub 123 and three other circumferentially spaced knife blades 124 on the opposite surface of the hub 123. The knife blades 124 fixed to each surface are circumferentially spaced at 120 deg. angles, with the blades on one side of the hub being circumferentially staggered by 60 deg. with respect to the knife blades on the opposite side of the same hub 123. The converging edges 125 of each knife blade 124 converge into a pointed end portion.

Each of the hubs 123 is fixed to the rotary shaft 119. Although the hubs 123 are axially spaced along the shaft 119, nevertheless, each of the hubs 123 is mounted at an angle to the longitudinal axis of the shaft 123. Preferably, the knife members 120 are each substantially planar and are mounted in such a manner that each pair of adjacent knife members 120 have their planes intersecting. Also preferably, the angle at which each planar knife member 120 intersects the rotary shaft 119 is circumferentially staggered relative to the angle at which the adjacent knife member intersects the rotary shaft 119. The adjacent pairs of the knife members 120 are so overlapped that for each revolution of the shaft 119 in the direction of the arrow disclosed in FIG. 11, some portion of a knife member 120 will engage the mixture of soils fed through the mixer head 118 by the upper run 18 of the feed belt 14. Thus, the layers of soils and chemical additives fed to the mixer head 118 are thoroughly mixed by the rotating knife members 120.

The mixer shaft 119 is driven through chain transmission 126 from mixer drive motor 127.

Each of the head rollers 101 and 103 of the chemical hoppers 24 and 25 are driven by corresponding motors and chain linkage transmission 128 and 129, respectively.

The feed belt 65 in the bottom of the second hopper 22 is driven by motor 130 through chain transmission 131 enclosed within drive housing 132. In like manner, the feed belt 90 is driven by a motor 133 and chain transmission 134 identical to motor 130 and transmission 131 and is encased within drive housing 135 (FIG. 1). Each of the upper runs of the feed belts 65 and 90 may be supported by the transverse idler rollers 137 and 138, if desired.

In the operation of the apparatus 10, the hopper 21 is first filled with a soil 38, such as peat moss. The second hopper 22 is filled with a different soil 60, such as bark, sand or top soil. In like manner, the third hopper 23 is filled with another soil 98, such as perlite, vermiculite, sand, Styrofoam, brick chips or sawdust.

The chemical hoppers 24 and 25 are each filled with a different chemical additive or mixture 105 and 106.

Each of the gates 32, 70, 94, 109, and 110 are vertically adjusted by means of their respective screws and crank handles to an elevation which will permit the desired volume rate of the respective soils and additives for discharge upon the underlying, continuously moving conveyor belt 14.

Although the motors 20, 128, 129, 130, and 133 drive their respective belts independently, nevertheless, they can be electrically or electronically tied together so that the speed of any one or more motors may be varied in order to control the speed of the respective conveyor belt 14 and the feed belts 99, 100, 65, and 90.

After the gate and/or motor speed adjustments have been made, the apparatus is actuated to energize all the motors, not only the feed belt motors, but also the mixer head motor 127, as well as the agitator drive motor 58.

As best disclosed in FIG. 3, the upper agitator shaft 41 is driven at a faster speed than the lower agitator shaft 47, and the upper agitator shaft 41 and the agitator shaft 75 in the second feed hopper 22 are driven at the same speed. Preferably, the speed of the upper feed shaft 41 is about 1.8 times the speed of the lower agitator shaft 47. Thus the lower sprocket 54 has a diameter in the ratio of 9:5 relative to the diameter of the upper sprocket 53. (FIG. 3)

After the apparatus 10 is actuated, the agitators 40 and 46 stir, beat, and blend the peat moss or other soil 38 in the first hopper 21. The soil 38 then gravitates upon the forward moving upper run 18 of the conveyor belt 14. The layer of soil 38 is then carried beneath hopper 22 where the agitated second soil 60 is fed in a controlled manner by the driven feed belt 65 through the discharge opening 68 and deposited in a layer upon the lower layer of soil 38. The two layers of soil 38 and 60 are then carried beneath the third hopper 23 where the third layer of soil 98 is deposited in a similar manner upon the lower layers of soil 38 and 60 by means of the driven feed belt 90 through the discharge opening 93. The three layers of soil are then carried beneath the two chemical hoppers 24 and 25 where the desired amount of chemical additives 105 and 106 are deposited upon the triple soil layer. The layered soils and additives are then conveyed into the mixing chamber 115 where they are tossed, stirred, and blended by the rotary knife members 120 of the mixer head 118. The mixer head 118 is particularly adapted for thoroughly mixing and blending the soils and additives without affecting the integrity of the soil particles.

While the mixed soils are in the chamber 115, they may be wetted or watered by one or more nozzles, not shown, connected to an inlet water line 139 (FIG. 1). In a preferred form of the invention, the peat moss 38 is also watered at the gate 32 by means, not shown. The peat moss is watered early because it requires a longer period to absorb water.

The mixed soils and additives, wetted if desired, are then discharged over the head end of the conveyor belt 14, preferably upon another conveyor 140 (FIGS. 1 and 2), to be transported to any desired destination, such as a potting station for potting or packaging plant or shrubbery stock.

In the apparatus 10 made in accordance with this invention, all of the hoppers 21, 22, and 23 may be of uniform height, yet the first hopper 21 is provided with greater depth for handling a greater volume or capacity of the first soil 38, such as peat moss. The peat moss 38 can be deposited directly upon the rear end portion of the forwardly moving conveyor belt 14, and then only the other soils subsequently deposited upon the peat moss 38 may be controlled by their corresponding feed belts 65 and 90.

In a typical plant grower soil mixture, the formula or proportions may be approximately 40% peat moss (soil 38), 30% bark or mulch (soil 60) and 30% sand or perlite (soil 98). Thus, the greater volume of soil 38 is deposited directly and initially by gravity upon the conveyor belt for transport beneath the subsequently deposited soils. Since the soil 38 is of a composition which tends to pack or cling together more than the other soils 60 and 98, the greater depth of the first hopper 21 permits the utilization of two agitators 40 and 46 instead of one to facilitate loosening of the fibrous peat moss.

Figure 11:
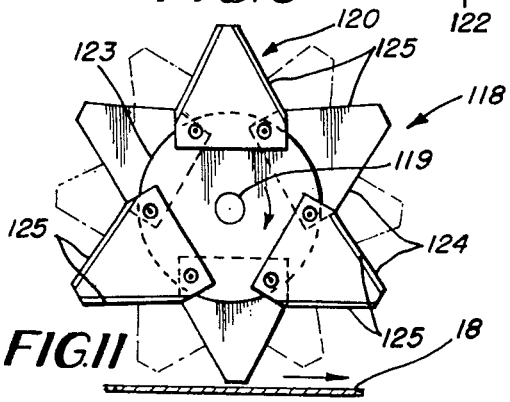
FIG. 11 is a section taken along the line 11—11 of FIG. 10, illustrating the relative angular positions of the knife blades.
Figure 10:
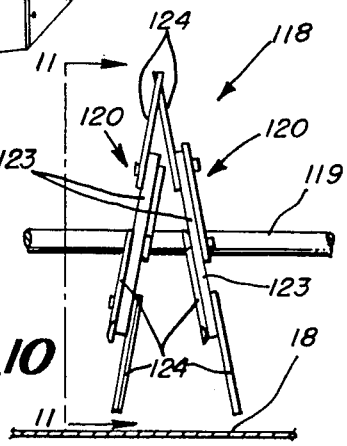
FIG. 10 is an enlarged, fragmentary, front elevational view of a portion of the rotary mixer head, taken along the line 10—10 of FIG. 9.

As disclosed in FIGS. 10 and 11, the periphery of the mixer blades 124 is spaced slightly above the top run 18 of the conveyor belt 14, preferably less than the thickness of the first soil layer 38 on the upper run 18 upstream of the knife members 120, so that the belt will not obstruct the movement of the knife members 120, and vice versa. The first soil 38 which forms the bottom layer of soil on the belt run 18 approaching the mixer head 118 must be of such composition that the blades 124 will engage all of the soil layers, including soil 38. Since peat moss is fibrous, it will readily be caught by the blades 12 when the peat moss forms the lowest soil layer 38. Since the blades 124 are moving in the opposite direction from the top belt run 18, all layers of soil, including the lowest layer of peat moss 38, will be tossed backward and upward continuously to form a well-blended mixture of soils and chemicals in the mixing chamber 115.

Soil, such as sand, perlite, or Styrofoam, if forming the lower layer on the belt 18, would normally pass beneath the mixer blades 120, without being mixed with the upper soil layers.

Not only does the mixer head 118 provide a more uniform blend of the soil layers and chemical additives, but it also improves the porosity of the peat moss, when used as the first soil 38, because the peat moss is expanded and fluffed to introduce air into the mixture and to increase the volume of the mixture.

What is claimed is:

1. A continuous soil mixing apparatus comprising:

(a) an elongated, endless conveyor belt having an elongated upper run for carrying soil deposited on said upper run, (b) conveyor drive means for driving said conveyor belt continuously in a longitudinal direction, (c) an elongated first hopper having upper and bottom portions and opposite end walls, and adapted to receive a first soil of predetermined composition, (d) an elongated second hopper having upper and bottom portions and opposite end walls, and adapted to receive a second soil of a composition different from said first soil, (e) support means mounting said first and second hoppers longitudinally spaced above the upper run of said conveyor belt, said second hopper being downstream from said first hopper, (f) said first hopper having an open bottom spaced directly above and proximate to said upper run, so that first soil received in said first hopper gravitates directly upon said upper run below said first hopper, (g) agitator means in said first hopper for breaking up said first soil in said first hopper, (h) an elongated, endless feed belt extending the length of the bottom portion of said second hopper for supporting the second soil received in said second hopper, (i) feed drive means for driving said feed belt to move second soil on said feed belt toward the downstream end of said second hopper, (j) a discharge opening in said second hopper at the downstream end of said feed belt through which said second soil is discharged from said second hopper by said feed belt upon the upper run of said conveyor belt and upon any of said first soil carried by said upper run, (k) a mixing chamber above said upper run downstream from said second hopper, (l) a rotary mixer device in said mixing chamber, and (m) mixer drive means for actuating said mixer device to continuously mix said layers of said first soil and said second soil carried on said upper run of said conveyor belt into said mixing chamber.

2. The invention according to claim 1 in which said agitator means comprises first agitator means, and further comprising second agitator means in said second hopper for breaking up said second soil in said second hopper.

3. The invention according to claim 2 further comprising an elongated third hopper having upper and bottom portions and opposite end walls, and adapted to receive a third soil of a composition different from said first soil and said second soil, said support means mounting said third hopper longitudinally above the upper run of said conveyor belt and spaced downstream from said second hopper, and means for discharging third soil from said third hopper upon said upper run and upon any of said first and second soils carried by said upper run.

4. The invention according to claim 3 in which said feed belt comprises a first feed belt, and in which said means for discharging third soil from said third hopper comprises a second endless feed belt extending the length of the bottom portion of said third hopper for supporting the third soil received in said third hopper, means for driving said second feed belt to move said third soil toward the downstream end of said third hopper, and a discharge opening in said second hopper at the downstream end of said second feed belt through which said third soil is discharged from said third hopper upon said upper run.

5. The invention according to claim 1 in which said agitator means comprises an elongated upper rotary agitator member and means mounting said upper agitator member in the opposite end walls of said first hopper for rotary movement, said agitator means further comprising an elongated, lower rotary agitator member and means mounting said lower agitator member in the opposite end walls of said first hopper for rotary movement of said lower agitator member in the bottom portion of said first hopper below said upper agitator member, and means for driving said upper and lower rotary agitator members to break up said first soil received in said first hopper.

6. The invention according to claim 5 in which said agitator means comprises first agitator means, and further comprising second agitator means in said second hopper comprising a second elongated rotary agitator member and means mounting said second agitator member in the opposite end walls of said second hopper for rotary movement, and means for driving said second rotary agitator member for breaking up the second soil received in said second hopper.

7. The invention according to claim 6 in which said means for driving said second agitator member comprises coupling means connecting said upper rotary agitator member in said first hopper and said rotary agitator member in said second hopper for simultaneous rotary movement of said upper agitator member and said second agitator member at substantially the same velocity.

8. The invention according to claim 7 in which each of said rotary agitator members comprises an elongated rotary shaft extending longitudinally of said respective first and second hoppers and agitator elements extending radially and longitudinally spaced from said corresponding rotary shaft to break up soil in said respective hoppers.

9. The invention according to claim 5 in which said means for driving said upper and lower agitator members comprises means for driving said upper agitator member at a rotary speed substantially greater than the rotary speed of said lower agitator member.

10. The invention according to claim 1 further comprising a chemical hopper mounted above the upper run of said conveyor belt downstream from said second hopper, said chemical hopper having an upper portion and a bottom portion, a chemical feed belt in the bottom portion of said chemical hopper for supporting soil chemicals received in said chemical hopper, and means for driving said chemical feed belt for depositing soil chemicals in said chemical hopper upon the upper run of said conveyor belt and any first and second soil carried by said upper run.

11. The invention according to claim 1 in which said rotary mixer device comprises an elongated mixer shaft, means journaling said mixer shaft transversely above said upper run of said conveyor belt in said mixing chamber for rotary movement, a plurality of knife members fixed to and longitudinally spaced on said rotary shaft and spaced slightly above said upper runs, and means for driving said mixer shaft so that the portions of the knife members below said mixer shaft move in a direction opposite to the direction of movement of said upper run.

12. The invention according to claim 11 in which each of said knife members comprises a hub member fixed to said mixer shaft, each hub member being mounted at an angle to the longitudinal axis of said mixer shaft, and a plurality of knife blades fixed to and extending radially from each of said hub members.

13. The invention according to claim 12 in which each of said knife members is substantially planar, the planes of each adjacent pair of knife members intersecting.

14. The invention according to claim 13 in which the knife blades on each hub member are circumferentially spaced and axially staggered from the knife blades on adjacent hub members.

* * * * *